US006694938B2

(12) United States Patent
Vilou

(10) Patent No.: US 6,694,938 B2
(45) Date of Patent: Feb. 24, 2004

(54) METHOD OF CONTROLLING A STARTER SYSTEM FOR A HEAT ENGINE, OF THE TYPE HAVING TWO STARTERS, AND APPARATUS FOR PERFORMING THE METHOD

(75) Inventor: Gérard Vilou, Tassin (FR)

(73) Assignee: Valeo Equipements Electriques Moteur, Creteil (FR)

( * ) Notice: Subject to any disclaimer, the term of this patent is extended or adjusted under 35 U.S.C. 154(b) by 132 days.

(21) Appl. No.: 10/058,302

(22) Filed: Jan. 30, 2002

(65) Prior Publication Data

US 2003/0140879 A1 Jul. 31, 2003

(30) Foreign Application Priority Data

Jan. 31, 2001 (FR) ..... 01 01342

(51) Int. Cl.[7] ..... F02N 17/00

(52) U.S. Cl. ..... 123/179.3; 123/179.25; 290/38 R

(58) Field of Search ..... 123/179.1, 179.2, 123/179.3, 179.5, 179.25, 438; 290/31, 36 R, 38 R, 47; 322/7, 9, 22, 23; 318/430, 431, 445, 438

(56) References Cited

U.S. PATENT DOCUMENTS

| | | | | |
|---|---|---|---|---|
| 4,955,336 A | * | 9/1990 | Glowczewski et al. | 123/179.3 |
| 5,132,551 A | * | 7/1992 | Carlo et al. | 307/10.3 |
| 5,397,925 A | * | 3/1995 | Carlo et al. | 307/10.3 |
| 5,983,850 A | * | 11/1999 | Vilou | 123/179.3 |
| 6,037,752 A | | 3/2000 | Glennon | |
| 6,093,974 A | * | 7/2000 | Tabata et al. | 290/40 R |
| 6,104,157 A | | 8/2000 | Kramer et al. | |

FOREIGN PATENT DOCUMENTS

| | | |
|---|---|---|
| FR | 2 574 484 A | 6/1986 |
| FR | 2 749 451 A | 12/1997 |

* cited by examiner

*Primary Examiner*—John Kwon
(74) *Attorney, Agent, or Firm*—Liniak, Berenato & White

(57) ABSTRACT

A heat engine has a starting system comprising two starters so arranged that their pinions engage the starter crown of the engine in parallel once the ignition key is turned. Each starter comprises an electric motor and a power interrupter connected in the power circuit of the motor and controlled by energizing a coil. The closing of the interrupter of one of the starters is delayed with respect to the other one. Reopening of one of the interrupters due to the voltage drop caused by closing the interrupter of the other starter is avoided by appropriate selection of the time delay.

19 Claims, 5 Drawing Sheets

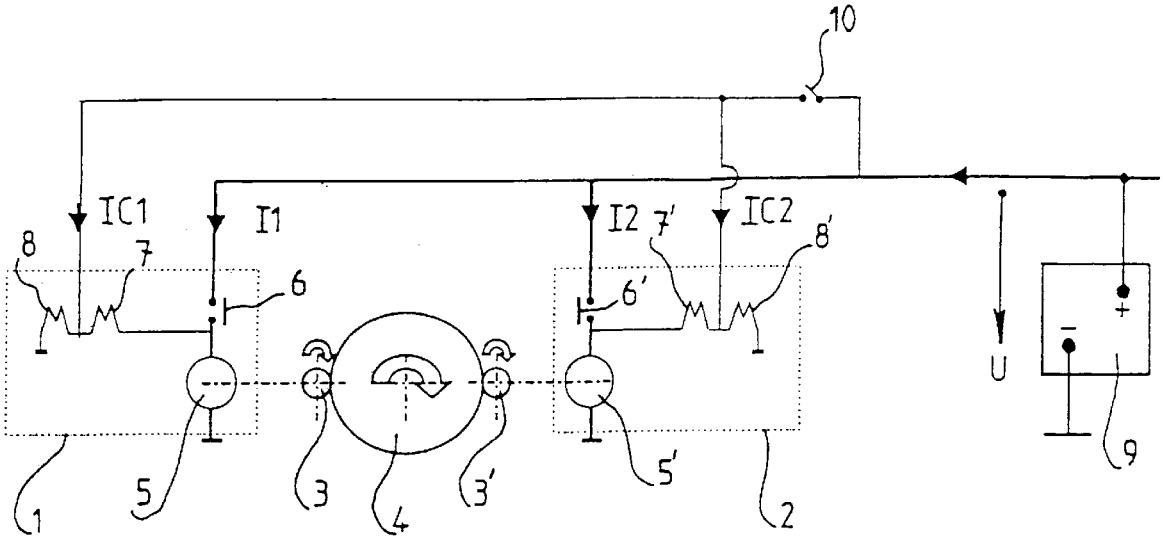
Fig.1
Fig.2
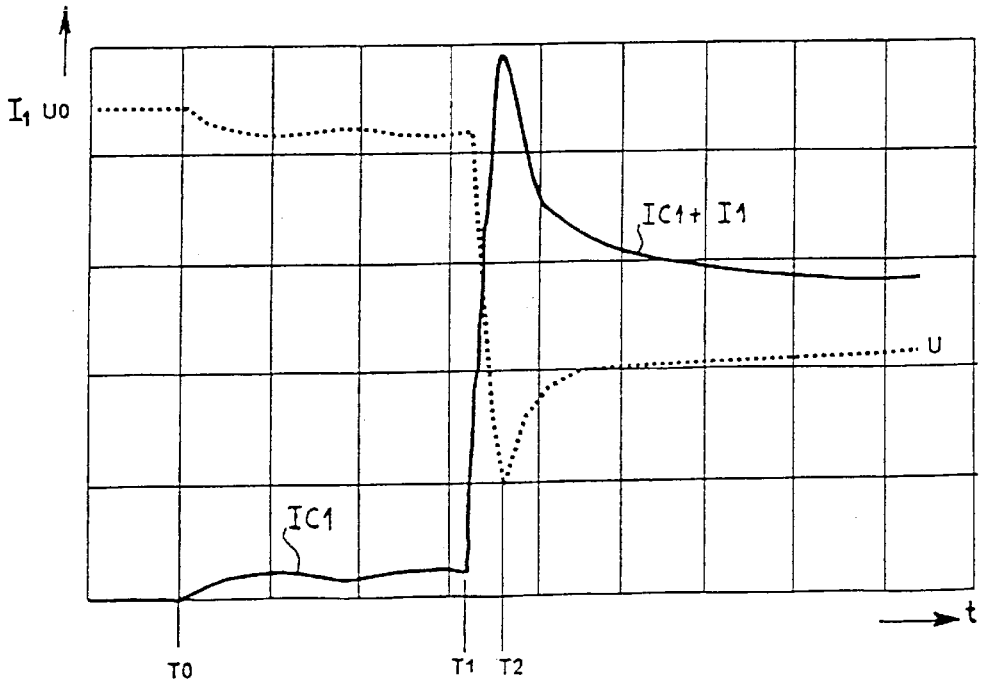

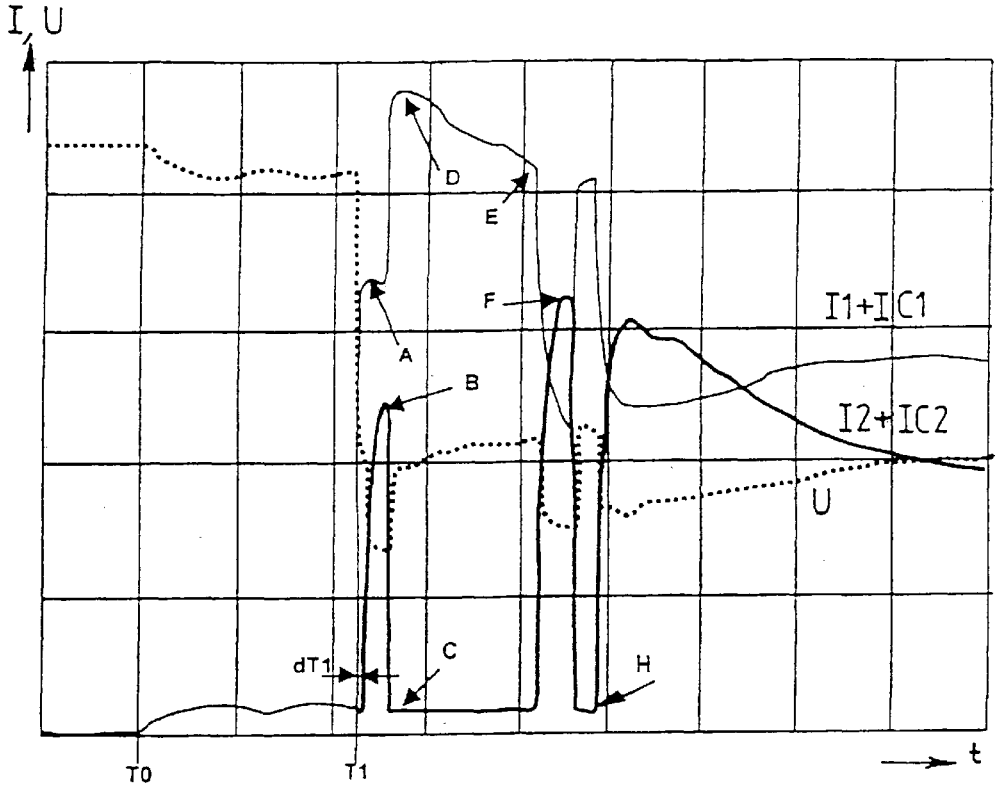
Fig. 3
Fig. 4
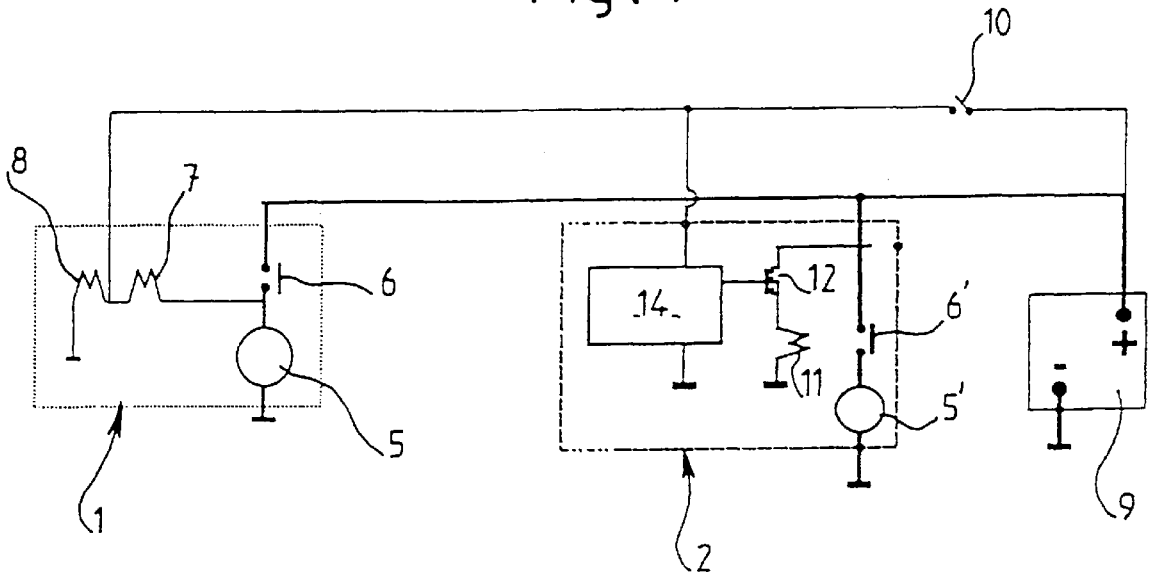

METHOD OF CONTROLLING A STARTER SYSTEM FOR A HEAT ENGINE, OF THE TYPE HAVING TWO STARTERS, AND APPARATUS FOR PERFORMING THE METHOD

FIELD OF THE INVENTION

This invention relates to a method of controlling a starter system for a heat engine, of the type comprising two starters so arranged that their pinions act in parallel on the starter crown of the engine after the ignition key has been actuated, each starter comprising an electric motor for driving its pinion and a power interrupter connected in the power circuit of the electric motor and controlled by a power supply to a coil.

The invention further relates to apparatus for performing the above methods.

STATE OF THE ART

Methods and apparatus of the above types are known at this time. In this connection, in some installations it is preferable to make use of two small starters in parallel rather than one single large starter. Thus, for very high capacity engines, the use of a pair of small mass produced starters instead of one single large starter made in smaller quantities may be more inexpensive.

Reference is here made to FIG. 1 of the accompanying drawings, described later herein under the heading "Brief Description of the Drawings".

The starter system shown diagrammatically in FIG. 1 includes two small starters 1 and 2, having respective pinions 3, 3' which actuate in parallel the starter crown 4 of the heat engine (not shown). The electric motors of the starters 1 and 2 are indicated at 5 and 5' respectively, and their power interrupters, or "contacts", at 6 and 6' respectively. Each of these interrupters is controlled by the moving core of an electromagnet which includes a starting coil, denoted 7 for the starter 1 and 7' for the starter 2, and a running coil, denoted 8 for the starter 1 and 8' for the starter 2. For more details about the construction of a starter of this type, reference may for example be made to French published patent specification FR 2 749 451A, given that such a starter may include only one coil in the manner described in French published patent specification FR 2 795 884A, in which the starter is again described.

Both starters are supplied with electrical energy from a battery 9 producing a voltage U, once the ignition has been switched on by the key 10. In such a starter system, each starter contributes its own power.

It has been found that starter systems of the kind shown in FIG. 1 are susceptible to serious variations in operating behaviour, such as to give rise to rapid deterioration of the starters in order to assist understanding of these behavioural eccentricities, the principle of operation of a starter of the twin-starter type, typified by the starters 1 and 2 in FIG. 1, will be briefly mentioned with reference to FIG. 2.

In FIG. 2, current is plotted against time T on the abscissa. It shows in the form of a full line the characteristic curve for the current taken by the starter, and, in broken lines, the voltage U available at the battery 9. On closure of the ignition key 10 at the moment t0, the running coil 8 and the starting coil 7 are simultaneously energised. The current IC1 absorbed by the coils is then generally between 40 and 60 amps for a system supplied at a nominal 12 volts. The battery voltage U, equal to U0 before the ignition key is closed, falls slightly because of the provision of the current IC1. Because of the magnetic effects of the coils, the current IC1 displaces the pinion 3 towards the crown 4 through the interposed moving coil of the starter contactor. At the instant t1, the power interrupter 6 closes the power supply circuit of the electric motor and thus causes the current I1 to flow, which causes a current peak IC1+I1, taken by the motor, to occur at the instant T2. This current IC1+I1 then reduces as the motor picks up speed. The starting current produces a very deep trough, which may reach 6 to 7 volts, in the voltage U. With effect from the instant t1, the contactor is supplied with power only through its single running coil 8. Its consumption falls back to a value of 8 to 10 amps. This results in a large fall in the value of the magnetic forces. However, this value does remain large enough to enable the magnetic core to finish its travel and to ensure, even at the instant t2, that the moving core is held magnetically against the fixed part of the contactor.

Reference is now made to FIG. 3 of the drawings, to explain the various behavioural anomalies which can occur due to starter operation as described above, where two conventional starters are combined in the manner shown in FIG. 1. FIG. 3 shows the characteristic curves of the currents IC1 and IC2 which are absorbed by the contactors of the two starters, the currents I1, I2 with which the electric motors 5, 5' are supplied, and the battery voltage U, all as a function of time t. When the ignition key 10 is closed at the instant t0, the power interrupter 6 of the starter 1 closes at the instant t1. The interrupter 6' of the starter 2 closes after a slight time delay dt of a few milliseconds, because of variations in the characteristics of the different starters. The total current IC1+I1 absorbed by the starter 1 rises sharply from the instant t1, and then slows and reduces at A because of the second starter 2, which consumes the total current in accordance with the curve I2+IC2. This gives rise to a very large drop in the battery voltage U. One of the two starters reaches its unengaged voltage threshold, this being generally the second starter because its moving core may not have finished its travel. The residual air gap existing at this instant reduces the magnetic forces. Since the return force is higher than the motive forces of the electromagnet, the moving core of this starter therefore returns to its rest position. The power interrupter 6' opens, and the current intensity drops from B to C. The battery, relieved of the consumption of this starter, sees an increase in its voltage which enables the power interrupter 6 of the starter 1 to stay closed. The starting peak of the latter once again rises, from A to D. This starter then begins to turn, and the intensity of the current I1+IC1 increases to the point E. In conjunction with this, the battery voltage U increases.

During this time, the power interrupter of the second starter 2, which has been open since the point C, once again permits simultaneous supply of power to the starting and holding coils. The magnetic forces are now increasing very sharply, especially since the battery voltage U is once again rising. The power interrupter of the second starter once again closes and causes a second peak to occur in the intensity of the current I2+IC2, at the point F. This causes the interrupter once again to open, for the same reasons as before. However, in the meantime, the speed of the motor 1 continues to increase, and therefore the intensity of the current it takes continues to diminish. On the third closing event at H, the sum of the currents absorbed by the two starters is low enough for there no longer to be any re-opening. Starting of the heat engine can then take place normally.

It can easily be understood that, when such starting conditions occur, the starters undergo sharp variations in operating mode, whereby severe forces are applied to them both from the mechanical point of view (by virtue of impulses on the shaft line, risk of disengagement of the crown, and so on), and from the electrical point of view (for example by virtue of sparking, and arcs on the commutators and contactor contacts when current peaks occur).

Apart from the undesirable effects described above, other disadvantageous phenomena can occur. These depend on the type of characteristics of the starters used. It can happen that the time difference dt mentioned above is very large if the first starter has the time to gather a high speed before the pinion of the second starter comes into contact with the starter crown. The velocity of the crown is then too high to enable that pinion to be able to engage. This gives rise to wear and rapid damage to both pinions and the crown. In addition, the moving core of the second starter may recoil by an amount high enough to disengage its pinion from the crown. During the second engagement at the time t2, the first starter drives the crown at a speed too high for the pinion of the second starter to be able to re-engage in the crown. As before, high wear and rapid damage to the pinion and crown will ensue.

In order to overcome these drawbacks, it has been proposed to provide relay units in which the power circuit for the starters is in series with a relay which will only close at the end of a certain time delay after the ignition is switched on. This enables the contactor to close fully and to be in a stable position at the instant when current peaks occur in the two starters.

It has also been proposed to insert in the power circuit of the two starters a resistance to reduce the magnitude of the current peak. This ballast resistance is short circuited by a relay when the current intensity has once again dropped sufficiently low, or when, with the aid of a time delay, a predetermined time has elapsed.

Such units do however have certain drawbacks, namely that they are expensive and bulky, and call for additional wiring of the vehicle which is more complicated and therefore more costly. In addition, control of these relay devices requires a high electric current, and as a result they cannot be operated directly through the ignition key. This then calls for an additional auxiliary relay.

OBJECT OF THE INVENTION

An object of the present invention is to propose a method and apparatus for starting, which mitigate, not only the disadvantages first described above, but also the disadvantages of known apparatus using relays.

DISCUSSION OF THE INVENTION

In order to achieve the above object, the method of controlling a heat engine starter according to the invention is characterised in that the closure of the power interrupter of one of the starters is delayed with respect to the other by a time delay the magnitude of which is chosen to be such as to avoid reopening of one of the interrupters that could be caused by the voltage drop produced by the closing of the power interrupter of the said other starter.

According to another feature of the invention, the closing of the said power interrupter is delayed by slowing down the displacement of the control core of that interrupter towards its closure position.

According to a further feature of the invention, the displacement of the core is slowed down by causing the supply current to that coil of the starter for which closing is retarded to be weaker than the current with which the coil of the other starter is supplied.

According to yet another feature of the invention, the intensity of the supply current to the coil of the starter for which closing is retarded is increased by a value which enables the core to pursue its travel to closure of the power interrupter during the drop in voltage produced by closing of the interrupter of the first starter.

According to a still further feature of the invention, the supply current of the retarded starter is increased on closing of the interrupter of the latter during a time interval such as to ensure engagement of its pinion in the starter crown.

According to another feature of the invention, the displacements of the cores of one of the starters and also the other are controlled, and the displacement of the core of the other starter is commenced at an instant of time between commencement of the movement of the core of the first starter and closure of the power interrupter of the latter.

According to a further feature of the invention, the supply current of one starter is controlled by command of an interrupter connected in the supply circuit to the coil of the starter.

According to yet another feature of the invention, where the interrupter is actuated by a pulse width modulated signal, the said supply current is controlled by causing the cyclic ratio of the latter to vary.

According to a still further feature of the invention, the cyclic ratio is appropriately chosen during various phases of the starting operation, in particular during the phase in which the first electric starter motor is itself started, the phase in which the second starter motor is started, and the phase in which the starter system drives the heat engine after the phase of complete engagement of the pinions of the two starters.

The apparatus for controlling starting of a heat engine, for performing the method according to the invention, is characterised in that at least one of the starters is equipped with an electronic control unit for controlling the starting of its electric starter motor.

According to another feature of the invention, an electronic interrupter is connected in the power circuit for the coil of the starter motor.

According to yet another feature of the invention, the electronic control unit produces a said pulse width modulated control signal for controlling the interrupter.

According to yet another feature of the invention, both starters are equipped with a said electronic control unit.

The invention will be better understood, and further objects, features, details and advantages of it will appear more clearly, in the following explanatory description which is given with reference to the attached diagrammatic drawings, which are however given by way of example only and which illustrate several embodiments of the invention.

BRIEF DESCRIPTION OF THE DRAWINGS

FIG. 1 is a diagrammatic view of a twin starter system as known in the current state of the art.

FIG. 2 shows characteristic curves which illustrate the operation of a conventional starter.

FIG. 3 is a diagram containing characteristic curves which illustrate the operation of the starter system shown in FIG. 1.

FIG. 4 is a diagrammatic view showing a starter system according to the present invention.

DESCRIPTION OF SOME PREFERRED EMBODIMENTS OF THE INVENTION

Figures 5A, 5B, 5C, 5D, 5E:
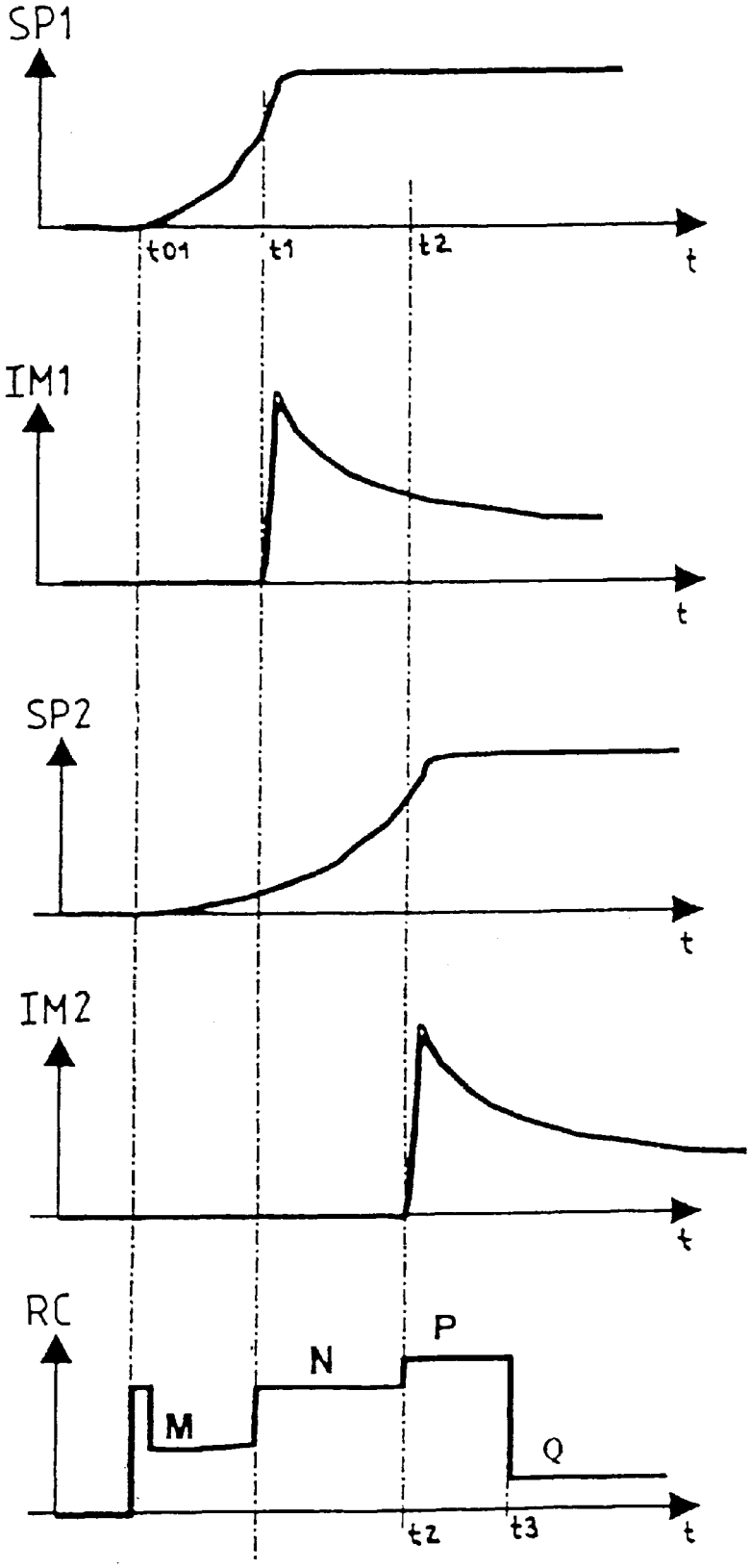
FIG. 5 consists of five diagrams, namely FIGS. 5*a* to 5*e,* which show the operation of the system of FIG. 4.

The starter system shown by way of non-limiting example in FIG. 4 is a starter system for a heat engine, having two starters 1 and 2. One of these, in this case the starter 2, includes an electronic unit for controlling its power interrupter 6'. This control unit may be a microcontroller. The starter 1 is of the same conventional type as that already described with reference to FIG. 1. It should be noted that in FIG. 4, the same reference numerals are used as in FIG. 1 to designate those elements or parts that are identical or similar.

The embodiment shown in FIG. 4 is distinguished in particular by the fact that the control winding of the power interrupter 6' comprises a single coil 11, and in the excitation circuit of the coil 11 there is an interrupter 12 which is controlled by the above mentioned electronic control unit, which has the reference numeral 14. This interrupter is preferably an electronic switch such as a transistor. The microcontroller is so programmed as to ensure operation of the starter 2 in accordance with the characteristic curves shown in FIGS. 5*c* to 5*e*.

Closing of the ignition key 10 connects the power supply simultaneously to the interrupters of both starters 1 and 2, namely the starter coil 7 and running coil 8 of the conventional starter 1, and of the electronic unit 14 for the starter 2. The moving core of the contactor of the starter 1 starts to move immediately at the instant t0 as shown in FIG. 5*a,* which represents the displacement of this core and therefore that of the pinion, as a function of time t. In the case of a conventional contactor, this core is displaced rapidly, causing rapid displacement of the pinion 3 to take place. As the core approaches the end of its travel, it closes the power interrupter 6 of the starter 1 at the instant t1. Closure of the interrupter 6 causes the current IM1 absorbed by the motor 5 to be sharply increased, to diminish again in accordance with the known characteristic curve for a conventional starter shown in FIG. 5*b*.

FIGS. 5*c* to 5*e* show the control of the process of closing the power contact 6' of the starter 2. As can be seen in FIG. 5*c,* the setting of the core of the contactor of the starter 2 in motion, and therefore the displacement of the pinion 3', are slowed down by the electronic control unit 14 in such a way that the power contact 6' of the starter 2 closes only at the instant of time t2. It is therefore only after the instant t2 that the electric current of the motor 5' increases sharply, to diminish subsequently according to the known characteristic curve for the current IM2 shown in FIG. 5*d*.

To ensure reduced speed displacement of the core and therefore of the pinion in accordance with FIG. 5*c,* the electronic control unit 14 commands the transistor interrupter 12 by means of a pulse width modulated (PWM) signal such as that shown by way of example in FIG. 5*e,* the cyclic ratio being the ratio of the conduction time of the transistor 12 to the total duration of a cycle. The signal enables a mean current to flow in the coil 11, and to evolve accordingly.

As can be seen in this Figure, after a starting phase during which the cyclic ratio RC has a relative high value which ensures that the core is released, the cyclic ratio is fixed at a relatively low value M which may for example be between 30 and 60%, up to the instant of time t1 at which the interrupter 6' closes. Starting from this instant t1, when the electronic unit 12, which continuously measures the voltage across the starter, finds that this voltage falls sharply following starting of the motor 5 of the starter 1, the control unit then adjusts the cyclic ratio upwards to a value N which lies between M and 100%. In this way, despite the drop in battery voltage, a current is maintained which is sufficient for the moving core of the starter 2 to be able to continue its travel for closing the magnetic circuit. The values M and N may be indexed to the temperature controlled by the control unit 14, whereby to give the best control of the magnitude of the excitation current for the coil 11.

Recognition that the starter 1 is started at the instant t1, and the change from the cyclic ratio M to the ratio N, may be achieved by detecting a significant voltage drop at the input of the electric motor 5 of the starter 1. This detection can be signalled to the control unit 14 of the starter 2, preferably over an electric wire which connects this input to the unit 14.

At the instant t2, the power interrupter 6' of the starter 2 closes. Closure of the interrupter 6' admits the power supply to the motor 5' of the second starter 2, and the motor current IM2 sharply increases as in FIG. 5*d,* which causes the voltage to fall again. The electronic control unit 14 thus changes the cyclic ratio RC to a higher value P which is between 80 and 100%. The cyclic ratio P is maintained up to the instant t3. This period is sufficiently long for the current IM2 of the second starter to have significantly exceeded its current peak (FIG. 5*d*), which ensures full penetration of the pinion 3' of this starter into the crown 4 of the heat engine. After the instant t3, the cyclic ratio falls again to a value Q which is low enough, being preferably less than M, to limit heating of the contactor, but which remains higher than the minimum value necessary to maintain the magnetic retention of the contactor of the second starter.

Many modifications can of course be applied to the development of the cyclic ratio RC such as has just been described with reference to FIG. 5*e*. Thus, the law of variation of the cyclic ratio with the values N, P and Q can include intermediate steps which the control unit 14 can initiate in accordance with predetermined programmes. The unit will choose the appropriate programme according to the temperature of the contactor and coil and the starter voltage. To this end, the control unit has two inputs which are arranged to receive values of temperature, from a temperature sensor located inside the contactor close to the coil, together with values of the voltage across the power terminals of the starter. In addition, the control unit includes a memory which contains a table of temperature values and reference voltages and cyclic ratios which it is appropriate to apply in order to ensure optimum control of the engine starting process, according to the measured temperature and voltage values.

The stepped variation of the cyclic ratio such as that shown may be replaced by continuous variation. Also, the change in the cyclic ratio from the value N to the value P may be started by a time delay which may be fixed or variable according to the temperature measured by the electronic unit 14. The change in the cyclic ratio from the value P to the value Q may begin when the control unit 14 senses that the measured battery voltage has reached a predetermined threshold value.

Again, the cyclic ratio N may be equal to the ratio P.

It is also possible within the scope of the invention to equip each of the two starters 1 and 2 with a unit 14 for controlling the moving core of the contactor through an electronic interrupter 12 such as a transistor, in the starter motor circuit.

Figures 6A, 6B, 6C, 6D, 6E, 6F:
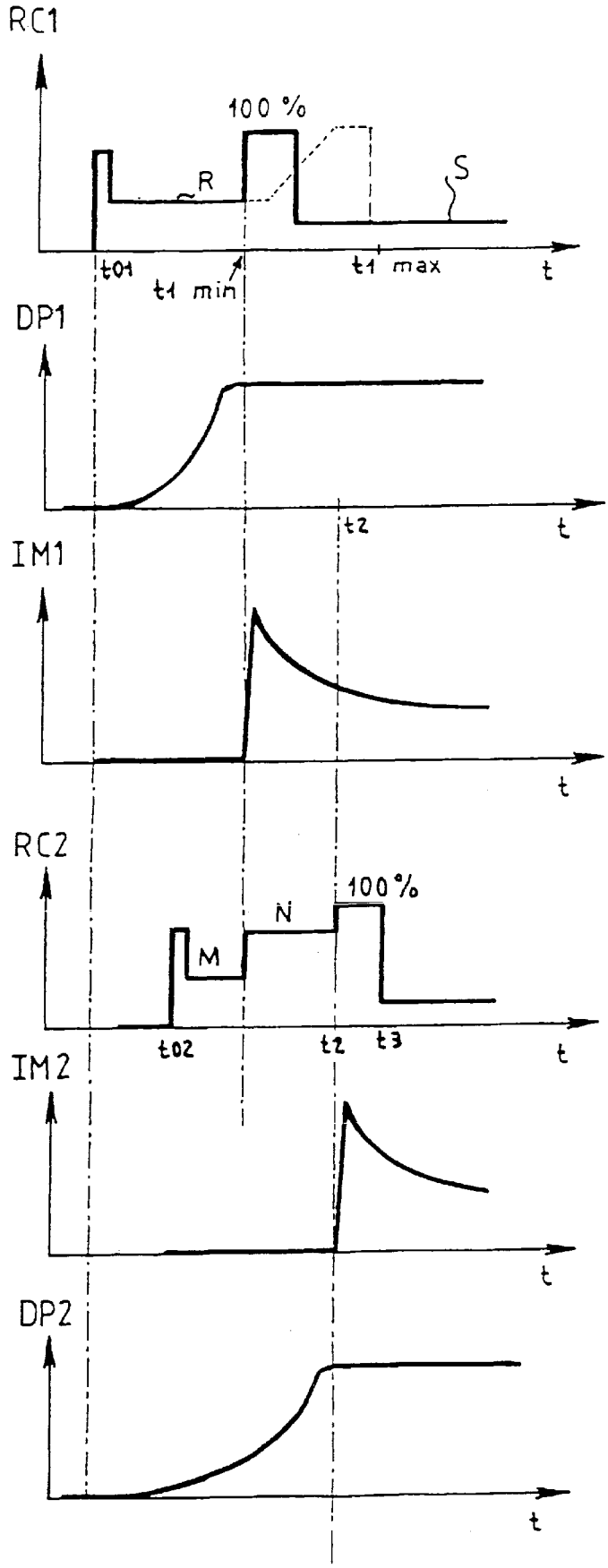
FIG. 6 consists of six diagrams, namely FIGS. 6*a* to 6*f,* illustrating the operation of a second embodiment of the invention.

Reference is now made to FIG. 6, which shows the operation of the two starters each under the control of its own control unit 14. Each of these control units may be a microcontroller. The diagrams in FIGS. 6*a* to 6*c* show the cyclic ratio RC1 for the first starter, the displacement DP1 of the moving core and the pinion, and the current IM1 which is absorbed by the starter 1. FIGS. 6*d* to 6*f* show the cyclic ratio RC2, the motor current IM2, and the displacement DP2 of the pinion of the second starter 2.

In FIG. 6*a,* the coil of the starter 1 begins to be energised as from the instant t0 as a result of a control signal from the microcontroller 14, having a cyclic ratio RC1 with a high value which can reach 100%. The corresponding supply current, which is therefore of high intensity, ensures release of the core from its rest position so that it is put in motion. This phase is short, being for example of the order of 2 to 10 milliseconds so that it only produces a higher tractive force on the core in order to release the latter. This phase is followed by a phase during which the cyclic ratio has a value R which is much smaller. The corresponding generally reduced current in the coil 11 is enough to overcome residual friction forces which oppose displacement of the core, after its release.

During this time period, which lasts about 30 to 60 milliseconds, the core continues its displacement until the power contact 6 is closed, gently and without excessive speed. During this phase of the cyclic ratio R, there is generally obtained an abutting contact between the pinion of the first starter and the starter crown. The cyclic ratio R may be chosen by the microcontroller with reference to the above mentioned digital table, so as to ensure optimum power supply to the coil as a function of temperature and available battery voltage, which the microcontroller is in position to monitor. In this connection, the mean current obtained for a given cyclic ratio depends directly on the voltage available across the starter terminals, that is to say across the battery, and on the resistance of the coil 11.

The moving core of the first starter closes the power contact 6 at the instant t1 to energise the electric motor 5. According to the various associated features prevailing, such as voltage, temperature, the relative position of the pinion and crown in the rest position, and ageing, including various factors such as wear, lubrication and so on, the closure of the power contact takes place between a minimum value t1min and a maximum value t1max. The diagram in FIG. 6*a* shows, by the full line, closure at the instant t1min, with establishment of the cyclic ratio by the microcontroller at the maximum value 100%, and the microcontroller then detects the drop in the supply voltage to the starter which is produced by the sharp increase in current at the instant t1min as shown in FIG. 6*c*. The development of the cyclic ratio from the instant t1min could also take place along the broken line in FIG. 6*a,* if the microcontroller does not detect the normal conditions for closing the contact at the instant t1min, that is to say in an accidental case in which the contactor has not been able to be closed at the instant t1min. Such an accidental situation can occur in particular if the friction forces are abnormally high in the contactor, in mechanical means for transmitting motion from the core to the pinion and in the region of the shaft of the motor 5. These abnormal forces could be due for example to climatic effects, or expansion, or jamming, to the presence of impurities or dirt or any other contaminant, especially in the region of the splines of the shaft of the electric motor and the pivots of the fork which connects the pinion to the hub.

When the microcontroller detects such conditions, it can choose a control programme as shown in broken lines, for governing the cyclic ratio. In accordance with this programme it first maintains the cyclic ratio R for a certain time and then increases it progressively up to a value of 100%. In both cases shown, the cyclic ratio is held at a maximum value for a certain time before the cyclic ratio falls to the holding value S.

The principle of this version of the control plan for the two starters in FIG. 6 consists in exciting the coil 11 of the starter 2 at the instant t02 before the instant t1, but after the instant t01, so that the moving core of the starter 2 starts to move before the voltage drop caused by the starter 1 takes place. However, it is necessary to choose the instant t02 of starting the core and pinion of the second starter as late as possible in order that, during closing of the power interrupter of the second starter at the instant t2, the voltage drop due to the first starter is attenuated sufficiently to prevent any risk occurring of either contactor reopening.

Given that t1min is variable, especially as a function of temperature, the time t02 may be indexed on temperature.

Evolution of the cyclic ratio RC2 in the second starter corresponds to that described above with reference to FIG. 5. The change from M to N, and that from N to 100%, take place respectively at the instant when the first starter closes and at the instant T2 when the second starter closes.

Figures 7A, 7B, 7C, 7D, 7E, 7F:
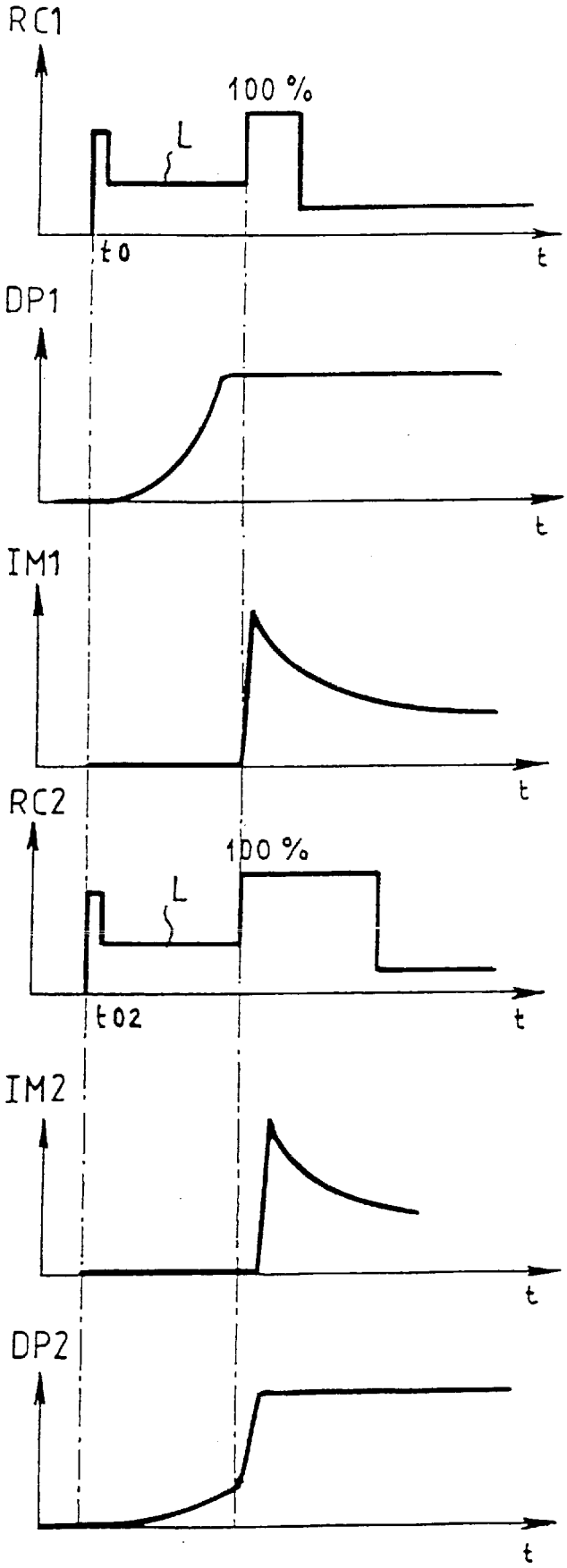
FIG. 7 consists of six diagrams, namely FIGS. 7*a* to 7*f,* illustrating the operation of yet another embodiment of the invention.

Reference is now made to FIG. 7, which illustrates another version of the control scheme for the two starters, each of which is equipped with an electronic control unit such as a microcontroller like the starter 2 in FIG. 4. In the present embodiment, both starters have similar response times. Two identical electronic control devices are therefore used, each of which is programmed in such a way as to work in the way shown in FIGS. 7*a* to 7*f,* with, in addition, the supplementary function whereby, when a sharp voltage drop is observed, the cyclic ratio immediately changes to at least 80%. Thus, when the faster of the two contactors closes its power contact 6, the microcontroller of the second starter, having detected a large voltage drop, controls the interrupter 12 in such a way that the coil 11 of the starter is supplied with a high current in order to accelerate closing of the interrupter. The two starters remain with a high cyclic ratio for quite a long time, so that the effects of voltage drops in the two starters are sufficiently attenuated to avoid the risk of the interrupters reopening. In practice, this duration may be between 50 and 300 milliseconds. At the end of this period, the contactors pass into a holding mode, with a cyclic ratio of the order of 15 to 40%. It is also possible to slow down the displacement of the core of the second starter by choosing a cyclic ratio with an appropriate value less than L.

What is claimed is:

1. A method of controlling a starting system for a heat engine, in a combination comprising the said heat engine, the said starting system coupled to the engine, and an ignition system having an ignition key, the heat engine including a rotatable starter crown, the ignition system comprising a first starter and a second starter, both connected electrically with the ignition system for activation by operation of the said key, each said first and second starters comprising, respectively: a first and a second electric starter motor; a rotatable first and second pinion driven by the corresponding said motor; and a first and a second power circuit, including in combination the corresponding said motor, a first and a second power interrupter, respectively, and a first and a second control coil, respectively, for actuating the corresponding said interrupter, wherein the said method includes the steps of:

operating the ignition key to enable each said control coil to be energised whereby to close the corresponding power interrupter to start the associated motor;

when each motor has started, engaging, by running of that motor, the pinion thereof with the starter crown, whereby both pinions engage the starter crown in parallel with each other so as to start the engine, retarding the closing of said second power interrupter with respect to the first by a time delay selected so as to prevent a voltage drop caused by closure of the first power interrupter causing reopening of the second interrupter.

2. A method according to claim 1, said first and second power interrupters including a first and a second control core, respectively, associated with the control coil of the interrupter for displacement by the coil in and out of a closing position in which the interrupter is closed, the step of retarding closing of a said interrupter comprising reducing the velocity of displacement of the control core of the interrupter towards its closing position.

3. A method according to claim 2, wherein the step of reducing the displacement velocity of the core of the said second interrupter consists in causing a weaker current to flow in the second control coil than in the first control coil.

4. A method according to claim 3, including the further step, when a said voltage drop occurs in the said first starter, of increasing the current in the coil of the said second starter by a value such that the second control core continues its travel whereby to close the second power interrupter.

5. A method according to claim 3, including the further step of increasing the current supplied to the said second starter on closure of the second power interrupter, during a time delay such as to ensure that the said first pinion engages in the starter crown.

6. A method according to claim 2, including the further step of controlling the displacements of the two said cores, and commencing the displacement of the first core at an instant of time between commencement of the displacement of the first core and closure of the first power interrupter.

7. A method according to claim 1, the power circuit of one of the said starters further including a control interrupter, wherein the method includes the further step of controlling the current supplied to that starter by operation of the said control interrupter.

8. A method according to claim 7, wherein the step of controlling the said current comprises sending a pulse width modulated signal to the control interrupter, and operating the latter by varying the cyclic ratio of the said signal.

9. A method according to claim 8, the engine starting system being adapted to start the engine by carrying out a procedure consisting of a plurality of phases, including: a phase of starting the said first starter motor; a phase of starting the said second starter motor; a phase of engaging the pinions of the two starters with the starter crown; and, after the last mentioned phase, a phase of driving the engine by means of the starters, the method including the step of selecting the said cyclic ratio appropriately during the various said phases, in particular during the phases specified in this claim.

10. A method according to claim 9, wherein the cyclic ratio increases stepwise until the second starter motor is started.

11. A method according to claim 9, wherein the cyclic ratio increases continuously.

12. A method according to claim 9, including the further step of detecting starting of the respective starter motors by detecting variation in the voltage across each starter, the step of selecting the cyclic ratio comprising establishing each cyclic ratio as a function of the detection of the said variation in the corresponding voltage.

13. A method according to claim 11, including the step of determining the instant at which the second starter is to be started by defining a time delay indexed on temperature and supply voltage of the starters.

14. A method according to claim 12, wherein the step of selecting the cyclic ratios comprises indexing the values of the cyclic ratios on the value of the supply voltage of the starters and their temperature, with reference to predetermined datum values.

15. A starting system for starting a heat engine by a method according to claim 1, wherein at least one of the said starters further includes an electronic control unit for controlling starting of the motor of that starter.

16. An engine system according to claim 15, further including an electronic control interrupter connected in the power circuit of the starter.

17. An engine starting system according to claim 16, wherein the said control unit is adapted to produce a pulse width modulated signal for actuating the said control interrupter.

18. An engine starting system according to claim 15, wherein the said electronic control unit includes means connected to the starters for detecting the voltage across each starter, and means for measuring the internal temperature of each starter.

19. An engine starting system according to claim 15, wherein each said starter has a said electronic control unit.

* * * * *